US008459171B2

(12) United States Patent
Cottle

(10) Patent No.: US 8,459,171 B2
(45) Date of Patent: Jun. 11, 2013

(54) GUN MOUNT FOR SEMI-AUTOMATIC FIREARM

(71) Applicant: Slide Fire Solutions LP, Moran, TX (US)

(72) Inventor: Jeremiah Cottle, Moran, TX (US)

(73) Assignee: Slide Fire Solutions LP, Moran, TX (US)

( * ) Notice: Subject to any disclaimer, the term of this patent is extended or adjusted under 35 U.S.C. 154(b) by 0 days.

(21) Appl. No.: 13/677,179

(22) Filed: Nov. 14, 2012

(65) Prior Publication Data

US 2013/0074685 A1 Mar. 28, 2013

Related U.S. Application Data

(63) Continuation-in-part of application No. 13/464,669, filed on May 4, 2012, which is a continuation of application No. 13/335,731, filed on Dec. 22, 2011, now Pat. No. 8,176,835, which is a continuation-in-part of application No. 13/281,808, filed on Oct. 26, 2011, now Pat. No. 8,127,658, which is a continuation-in-part of application No. 12/949,002, filed on Nov. 18, 2010.

(60) Provisional application No. 61/262,315, filed on Nov. 18, 2009, provisional application No. 61/560,379, filed on Nov. 16, 2011.

(51) Int. Cl.
*F41A 23/00* (2006.01)

(52) U.S. Cl.
USPC ..... 89/37.04; 89/128; 42/94

(58) Field of Classification Search
USPC ..... 42/94, 106, 69.01, 75.03; 89/37.01, 89/37.03, 37.04, 127, 128, 129.01, 129.02, 89/140, 136
See application file for complete search history.

(56) References Cited

U.S. PATENT DOCUMENTS

| | | | |
|---|---|---|---|
| 554,068 | A | 2/1896 | Kimball |
| 981,210 | A | 1/1911 | Menteyne et al. |
| 1,587,009 | A | 1/1926 | Bobbe |
| 2,220,663 | A | 11/1940 | Rossmanith |
| 2,361,985 | A | 11/1944 | Birkigt |
| 2,465,587 | A | 3/1949 | Sampson et al. |
| 3,031,786 | A | 5/1962 | Robert |
| 3,785,243 | A | 1/1974 | Christakos |

(Continued)

OTHER PUBLICATIONS

"[Archived Thread]—My Akins Accelerated 10/22 can kick your 10/22 ass . . . " Purported Internet discussion thread. Aug. 13-22, 2006. (Copyright); Relevant pages may include p. 3 of 5. [http://www.ar15.com/forums/t_6_11/203814_.html].

(Continued)

*Primary Examiner* — Benjamin P Lee
(74) *Attorney, Agent, or Firm* — Endurance Law Group PLC

(57) ABSTRACT

A mount assembly for a semi-automatic firearm supports the weight of a firing unit (receiver, barrel and trigger) in a slide stand on or from a support structure so that a user does not have to bear any or at least a significant portion of the firearm's weight. Through a sliding interface, the firing unit is manually pushed by a user's thumb(s) to slide forward in the slide stand until a trigger actuator depresses the trigger. The trigger actuator may include a rod or a rest for a user's finger. Recoil energy from a discharged bullet pushes the firing unit rearwardly back to the starting position. The slide stand can include a convex or articulating base for variable aiming, or a fixed base for sharp-shooting.

24 Claims, 11 Drawing Sheets

U.S. PATENT DOCUMENTS

| | | | |
|---|---|---|---|
| 4,002,101 | A | 1/1977 | Tellie |
| 4,553,468 | A | 11/1985 | Castellano et al. |
| 4,787,288 | A | 11/1988 | Miller |
| 4,803,910 | A | 2/1989 | Troncoso |
| 5,074,190 | A | 12/1991 | Troncoso |
| 5,092,052 | A | 3/1992 | Godsey |
| 5,780,762 | A | 7/1998 | Kobayashi |
| 5,852,891 | A | 12/1998 | Onishi et al. |
| 5,979,098 | A | 11/1999 | Griggs |
| 6,101,918 | A | 8/2000 | Akins |
| 6,164,002 | A | 12/2000 | Troncoso |
| 6,807,762 | B1 | 10/2004 | Edwards |
| 6,966,138 | B1 | 11/2005 | Deckard |
| 7,225,574 | B2 | 6/2007 | Crandall et al. |
| 7,273,002 | B1 | 9/2007 | Rogers |
| 7,340,857 | B1 | 3/2008 | Bentley |
| 7,398,723 | B1 | 7/2008 | Blakley |
| 7,562,614 | B2 | 7/2009 | Polston |
| 7,596,900 | B2 | 10/2009 | Robinson et al. |
| 8,051,593 | B2 | 11/2011 | Vesligaj |
| 2005/0183312 | A1 | 8/2005 | Speaks |
| 2006/0123683 | A1 | 6/2006 | Garrett et al. |
| 2010/0071246 | A1 | 3/2010 | Vesligaj |
| 2012/0042556 | A1 | 2/2012 | Vesligaj |

OTHER PUBLICATIONS

"Akins Accelerator Decision v 2.0"; Purported internet discussion thread. Jan. 9-Jun. 30, 2007. [http://thefiringline.com/forums/archive/index.php?t-234087.html].

"Another neutered Akins accelerator FS"; Purported internet discussion thread. Jan. 19-30, 2009. [http://1919a4.com/showthread.php?21872-Another-neutered-Akins-accelerator-FS].

"ATF reverses decision . . . "; Purported internet discussion thread. Dec. 6-24, 2006. [http://www.thehighroad.org/archive/index.php/t-240357.html].

"Bill_Akins > albums > Private concepts"; Purported video posted to internet. Oct. 16, 2008. [http://good-times.webshots.com/video/3011228380099763970axOjzH].

"Just Wanted to Show Off My Bumpfiring Toy"; Purported internet discussion thread with embedded videos. Nov. 13, 2008-May 14, 2010; Relevant pages may include p. 1 of 2. [http://forum.saiga-12.com/index.php?/topic/31610-just-wanted-to-show-off-my-bumpfiring-toy-p/].

"More Thoughts on the Akins Accelerator"; Purported Internet discussion thread. May 29, 2008-Sep. 25, 2009. [http://armsandthelaw.com/archives/2008/05/atkins_accelera.php].

"Screw the ATF and 1022"; Purported internet discussion thread. Apr. 10-11, 2007. [http://www.thehighroad.org/archive/index.php/t-268573.html].

"Turn in Your Killer Springs Here"; Purported internet discussion thread. Jan. 9-10, 2007. [http://www.thehighroad.org/archive/index.php/t-246764.html].

Michael Foeller II letter from US US Department of Justice, Bureau of Alcohol, Tobacco, Firearms and Explosives, Jun. 18, 2008.

Michael Johnson letter from US Department of Justice, Bureau of Alcohol, Tobacco, Firearms and Explosives, Jun. 26, 2008.

GUN MOUNT FOR SEMI-AUTOMATIC FIREARM

CROSS REFERENCE TO RELATED APPLICATIONS

This application claims priority to Provisional Patent Application No. 61/560,379 filed Nov. 16, 2011, and this application is a Continuation-In-Part of U.S. Ser. No. 13/464,669, filed May 4, 2012, which is a Continuation of U.S. Ser. No. 13/335,731, filed Dec. 22, 2011, now U.S. Pat. No. 8,176,835, which is a Continuation-In-Part of U.S. Ser. No. 13/281,808, filed Oct. 26, 2011, now U.S. Pat. No. 8,127,658, which is a continuation-In-Part of U.S. Ser. No. 12/949,002, filed Nov. 18, 2010, now US2011/0113665, which claims the benefit of U.S. Provisional Application Ser. No. 61/262,315 filed Nov. 18, 2009, the entire collective disclosures of which are hereby incorporated by reference and relied upon.

BACKGROUND OF THE INVENTION

1. Field of the Invention

The present invention relates generally to an apparatus and method for shooting firearms, and more particularly toward an improved gun mount in which the weight of a semi-automatic firearm is slidably supported for human-powered rapid-fire action.

2. Related Art

Various techniques and devices have been developed to increase the firing rate of semiautomatic firearms. Many of these techniques and devices make use of the concept known as "bump firing", which is the manipulation of the recoil of the firearm to rapidly activate the trigger. Although able to achieve a high rate of firing, traditional techniques for bump firing are somewhat unsafe and notoriously inaccurate. Another issue with traditional bump firing techniques relates to the general difficulty for handicapped individual to participate. Because of the unnatural and unbalanced firing grip, the firearm is very difficult to hold and control during the traditional bump firing methods.

The shooting sports are enjoyed by people from all walks of life. Many of these have honored their country with military service. As is too often the case, some have sustained disabling injuries. The desire and enjoyment of shooting firearms does not usually subside in the aftermath of physical handicaps. Likewise for those individuals who live with physical handicaps sustained from birth or in non-military events, there is often a continuing desire to shoot firearms for pleasure and fellowship.

There exists a need for further improvements in devices allow the operator to practice new and interesting ways to shoot firearms in a legal and safe manner, to increase the firing rate of semi-automatic firearms without compromising the safety of the operator or the accuracy of the firearm. Such improvement should be generally universally functional without respect to ammunition type, and should be designed in such a manner that handicapped shooters can use them comfortably.

SUMMARY OF THE INVENTION

The invention contemplates a mount assembly for a semi-automatic firearm. The mount assembly supports a semi-automatic firing unit composed of a receiver and a barrel and a trigger. The firing unit also includes a pressure applicator. A slide stand supports the weight of the firing unit on or from a support structure so that a user does not have to bear any or at least a significant portion of the firearm's weight. The slide stand includes a sliding interface that slidably connects to the firing unit so that in use the firing unit may freely reciprocate back-and-forth relative to the slide stand. Through this sliding interface, a constrained path of reciprocation is established which is generally parallel to the firearm barrel. The slide stand also includes at least one grip location for a user to grasp when firing the firearm. A trigger actuator is configured to depress the trigger when the firing unit is moved forwardly in the slide stand. The slide stand and the firing unit are arranged without spring force assistance acting therebetween so that in use a user's muscle effort applied through the pressure applicator moves the firing unit longitudinally forward within the slide stand to press the trigger actuator against the trigger in order to discharge a round of ammunition without requiring the user to support the weight of the firing unit.

The present invention enables shooting enthusiasts to practice new and interesting ways to shoot firearms in a legal and safe manner, and is substantially more conducive to use by handicapped shooters.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
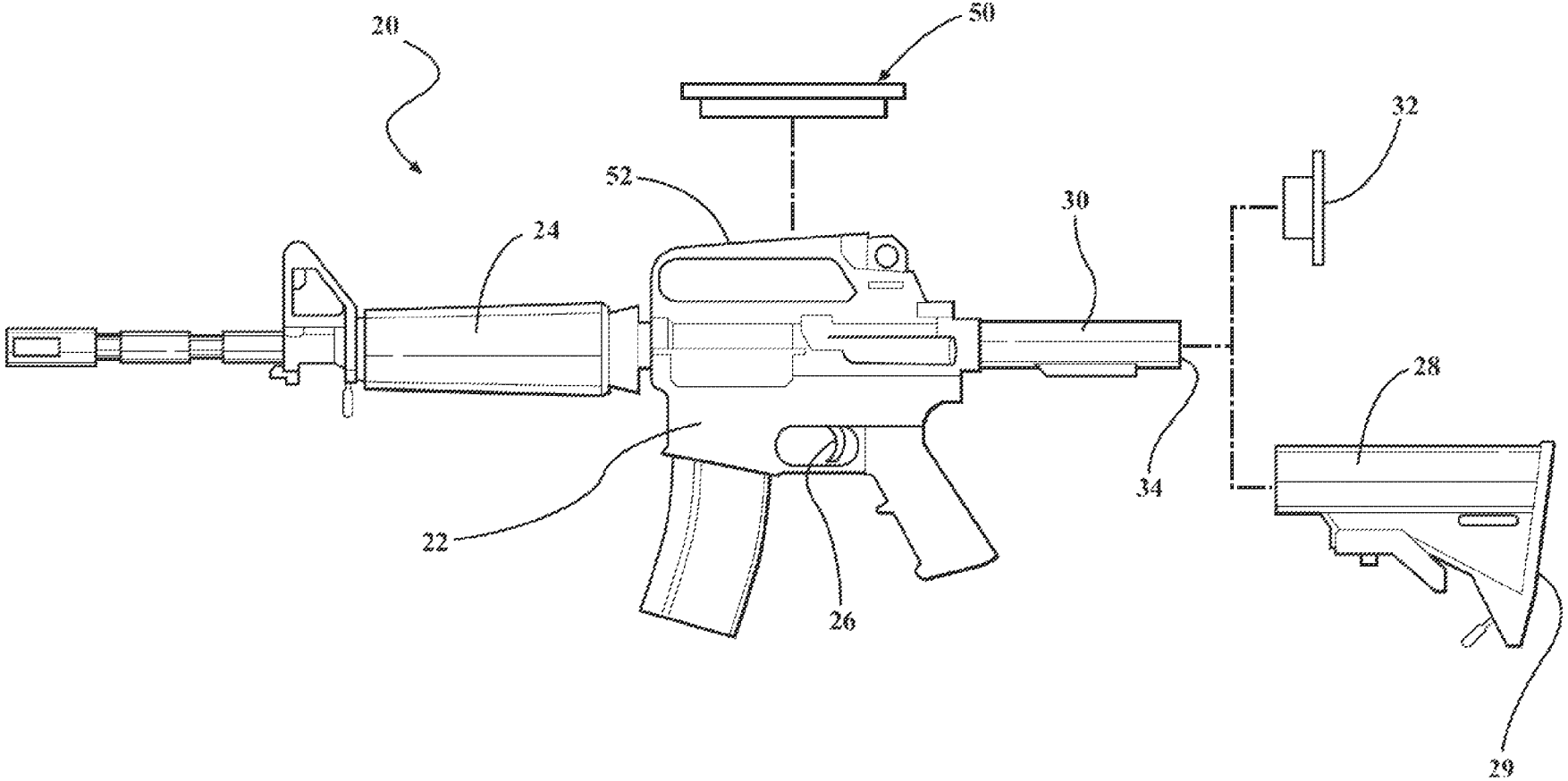
FIG. 1 is a partially exploded side view of a semi-automatic firearm of the type configured for use in the present invention.
Figure 2:
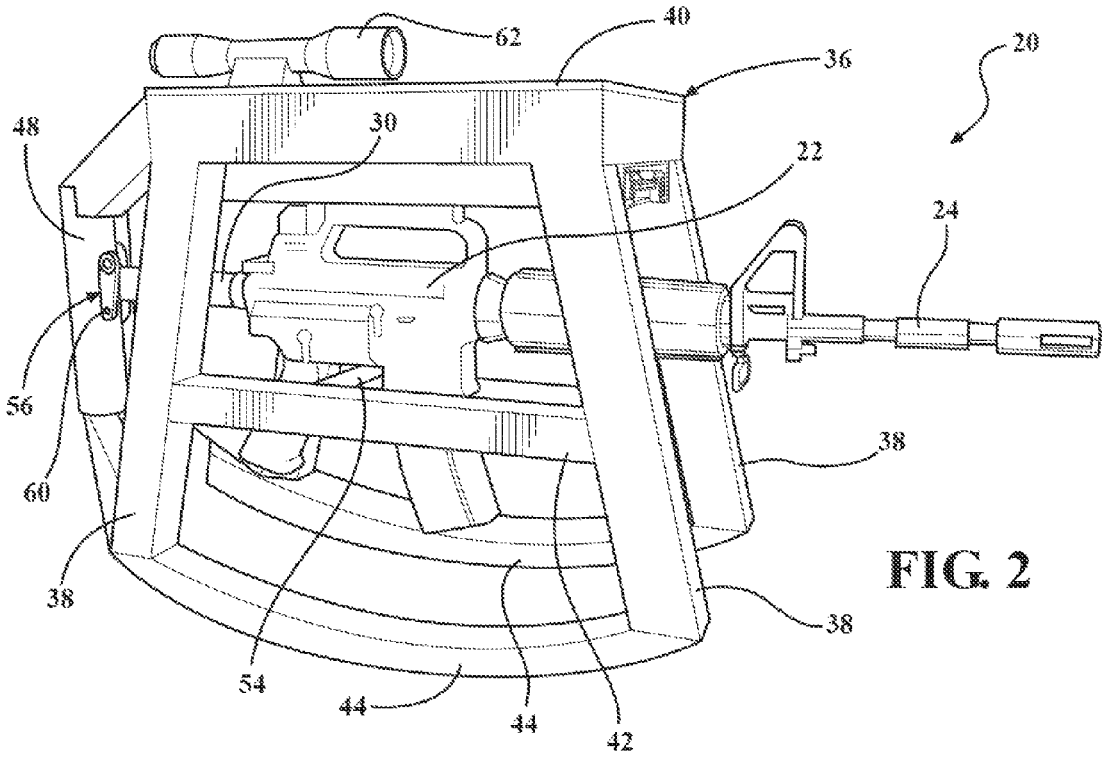
FIG. 2 is a perspective view of a firing unit disposed within a slide stand according to a first embodiment of the invention.
Figure 3:
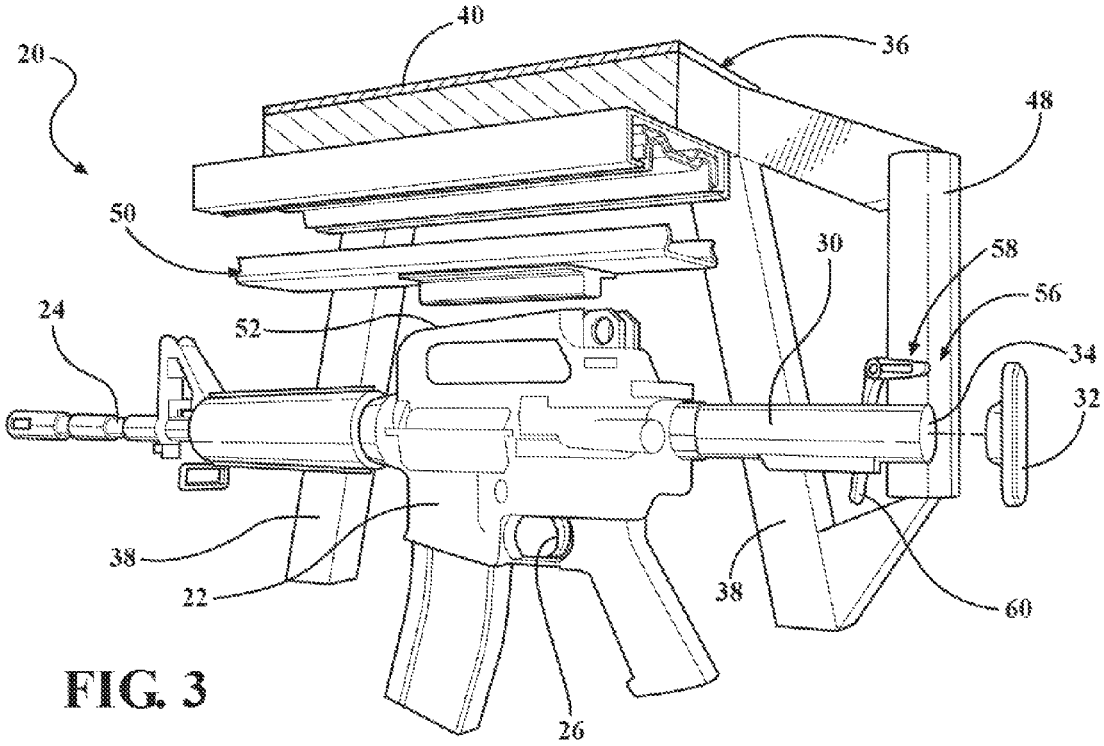
FIG. 3 is an exploded and partially sectioned view of the firearm assembly.
Figure 4:
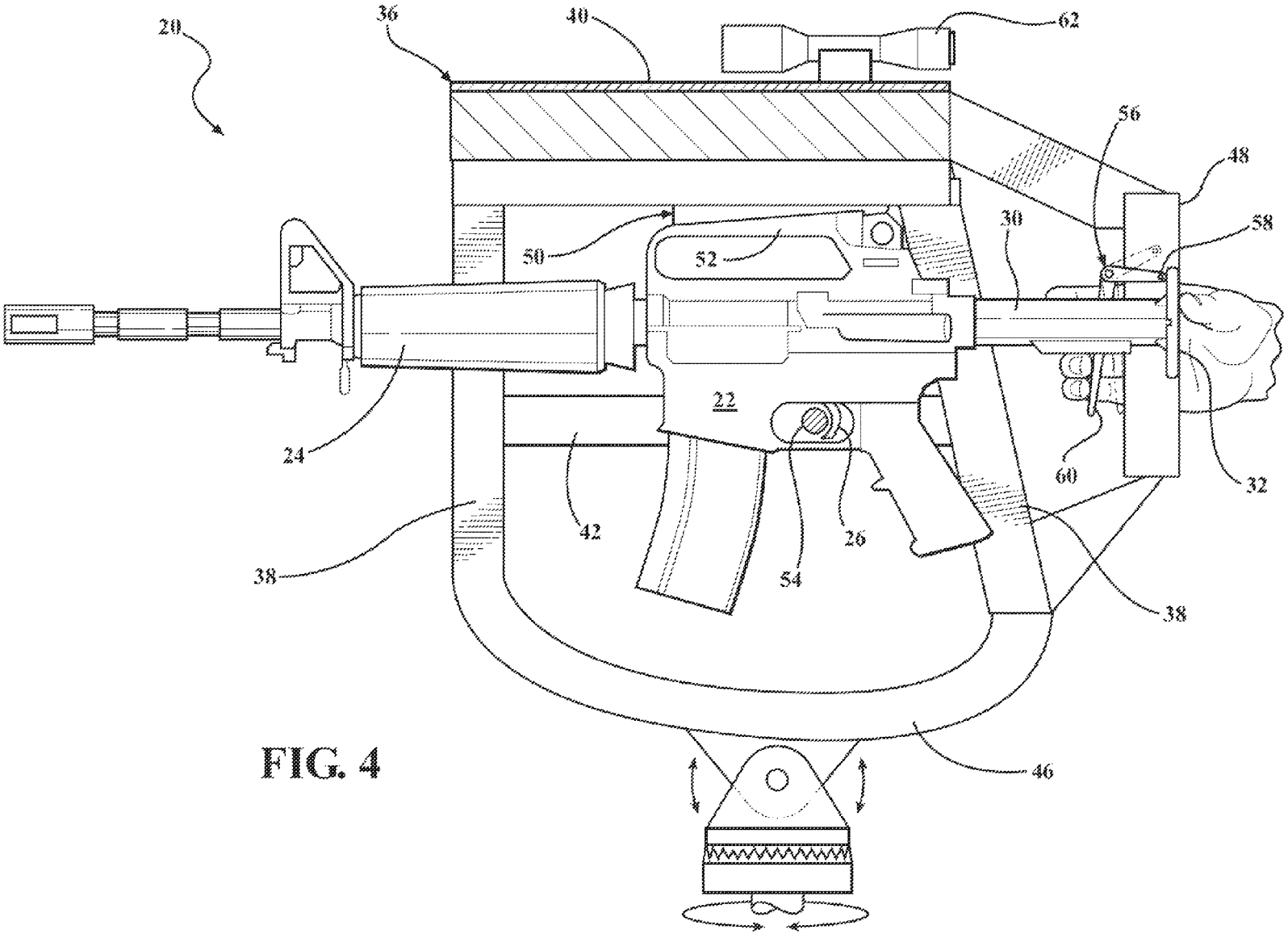
FIG. 4 is a partially sectioned side view of the firearm assembly showing an alternative articulating base feature.
Figure 5:
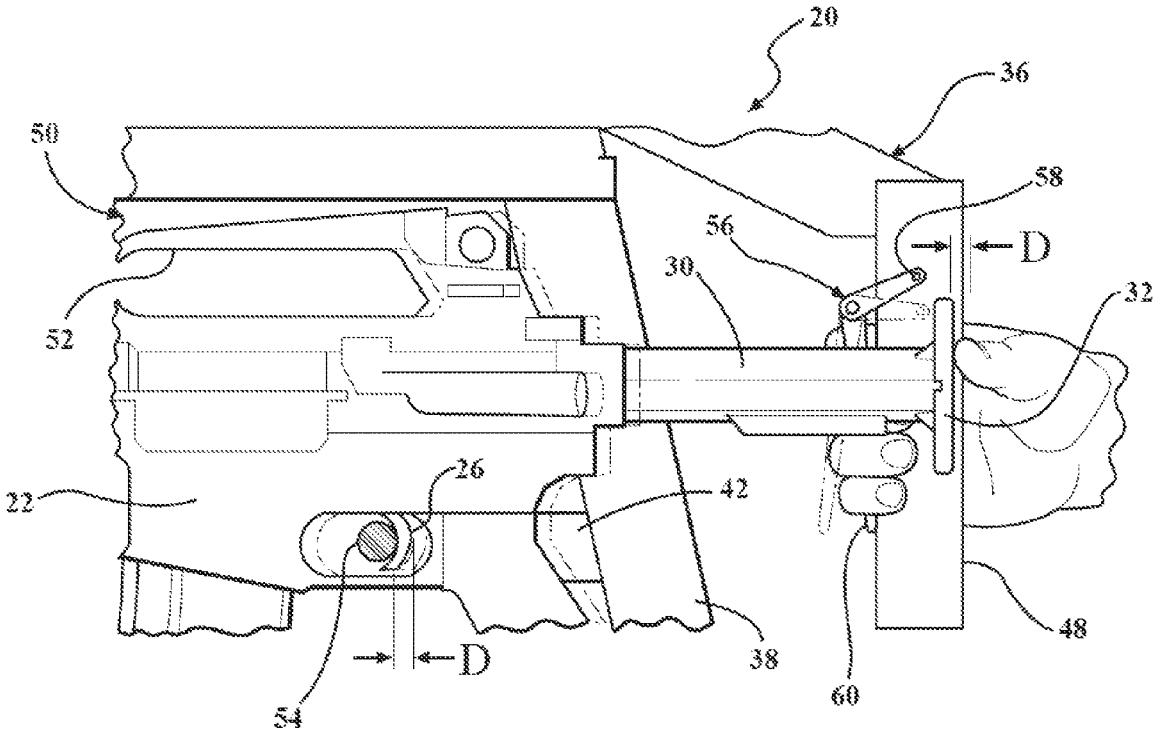
FIG. 5 is an enlarged fragmentary view illustrating how the user's thumb action against a pressure applicator results in a corresponding engagement of a trigger actuator with the firearm trigger.

Referring to FIGS. 1-5, wherein like numerals indicate like or corresponding parts throughout the several views, a typical sporting-type semi-automatic firearm is shown at 20. The firearm 20 includes a receiver 22 for chambering a round of ammunition, a barrel 24 extending forwardly from the receiver 22, and a trigger group 26 supported in the receiver 22. The trigger group 26, or informally just "trigger" 26, is configured so that when it is pulled rearwardly it activates a firing pin (not shown) that in turn strikes the primer of a chambered round of ammunition disposed in a breech portion of the receiver 22 and/or barrel 24, thus discharging the projectile portion (i.e., bullet) through the barrel 24 and downrange toward an intended target. The firearm 20 may also include additional features like sighting devices, guards, straps, and the like as will be readily understood by those of skill in the art, some of which are described in greater detail below. The receiver 22 and barrel 24 and trigger 26 are moveable together as a firing unit. In at least the AR-10 and AR-15 platform firearms, a buffer tube 30 extends rearwardly from the receiver 22 of the semi-automatic firearm 20.

For traditional use of the firearm 20, an adjustable or fixed shoulder stock 28 may be disposed on the buffer tube 30, as shown (exploded) in FIG. 1, and held by the user pulled tight against their shoulder so that the user's cheek lays against a side of the shoulder stock 28 for aiming or sighting. However, for in the modified use contemplated by this invention, where the user does not support the weight of the firearm 20 in order to achieve a controlled rapid fire of bullets, the extreme rear or butt end 29 of the shoulder stock 28 serves as a pressure applicator to actuate the firing system. According to the embodiment of this invention depicted in FIGS. 1-5, the shoulder stock 28 is removed so that the firearm 20 is operated through interaction with a pressure applicator attached to the distal or rearward end 34 of the buffer tube 30. The pressure applicator may be configured as an oval or other suitably shaped thumb pad 32 with or without a cushioned surface. In firearm types that do not utilize a buffer tube 30, e.g., and AK-47, the thumb pad 32 can be reconfigured or the extreme rear or butt end of the firearm's standard shoulder stock may be used instead as a pressure applicator. Indeed, even in the AR-15 embodiment illustrated in FIG. 1, the shoulder stock 28 may be left in position to accomplish the shooting method of this invention via its butt end 29, i.e., instead of substituting the thumb pad 32.

A slide stand, generally indicated at 36, is provided for slidably supporting the weight of the firing unit, i.e., the weight of the conjoined receiver 22 and barrel 24 and trigger 26, on or from a support structure. The support structure could be underlying in the case of the ground, a bench rest or shooting table, a pedestal, the roof or hood or tailgate of an off-road vehicle, or any other suitable stable structure. Those of skill in the art may envision an overhead structure that is capable of supporting the weight of the firing unit, such as from the door or window frame of a military vehicle. The slide stand 36 supports the firearm 20 in use for aiming and shooting while bearing all or at least a significant portion of the weight of the firearm 20 so that the user does not bear any (or nearly any) weight load.

In the example of FIGS. 2-5, the slide stand 36 includes a frame composed of legs 38 and a top 40. Those of skill will envision many alternative configurations with those illustrated here serving mainly to communicate the general functionality of the slide stand 36. Stretchers 42 may be added between two or more legs 38 to improve structural integrity of the frame. In one embodiment shown in FIG. 2, a convex base 44 is provided including curved runners somewhat akin to a rocking horse or chair. Alternatively, the convex base 44 could be domed or pyramidal or comprise a monopod-like or shooting stick type point. An objective of the convex base 44 is to enable the user to easily aim the firearm 20 right-left-up-down without bearing the weight of firearm 20. In another embodiment shown in FIG. 4, the base comprises an articulating pintle mount 46 that allows the tiring unit to be freely traversed and/or elevated while simultaneously bearing the weight of firearm 20 so that the user need only aim and apply pressure through the thumb pad 32.

The slide stand 36 includes at least one grip location for a user to grasp when firing the firearm. In the exemplary embodiment shown in FIGS. 2-5, the grip location includes an double handle spade grip 48 akin to the spade grip styles found traditionally in some mounted military style guns. The twin handles of the spade grip 48 are disposed adjacent to the thumb pad 32 on opposite sides so that a user's thumb(s) will naturally rest against the thumb pad 32 when grasping one or both of the handles. At least one of the spade grip 48 and/or the thumb pad 32 can be made adjustable relative to the other to achieve ergonomic relationship so that a user's hand(s) can comfortably touch both grip 48 and pad 32 simultaneously. It should be appreciated, however, that the grip location of the slide stand 36 could take many different forms other than a spade grip 48. Some alternatives are described below, and those of skill will readily envision other but equivalent configurations.

The slide stand 36 further includes a sliding interface, generally indicated at 50. The sliding interface 50 slidably connects to the firing unit so that in use the firing unit freely reciprocates back-and-forth relative to the slide stand 36. More particularly, the sliding interface 50 establishes a constrained path of reciprocation that is linear, and that is aligned generally parallel to the length of the barrel 24. It should be mentioned that the constrained reciprocating path is preferably linear, but in various contemplated embodiments could be curvilinear. Also, alignment exactly parallel to the bore of the barrel 24 is preferred, but some moderate degree of skewing will not unduly hinder performance. In the embodiment shown in FIGS. 2-5, the sliding interface 50 takes the form of a simple rail system affixed through the handle/scope mount portion 52 of the upper receiver 22. In other model types, however, the sliding interface 50 may be configured very differently.

The sliding interface 50 is constructed so that there is no spring force assistance acting between the slide stand 36 and the firing unit, at least in the forward direction opposing the recoil force. As a result of the absence of any recoil-opposing spring force, in use a user's muscle effort applied through the pressure applicator 32 moves the firing unit longitudinally forward within the slide stand 36 without requiring the user to support the weight of the firing unit. Similarly, the firing unit is moved longitudinally rearwardly within the slide stand 36 by recoil energy without requiring the user to support the weight of the firing unit. It should be understood that in this latter condition the user may be required to oppose the recoil force through the grip location depending on the type of base mounting system employed.

The assembly includes a trigger actuator 54 configured to depress the trigger 26 when the firing unit is moved forwardly in the slide stand 36. In use a user's muscle effort applied through the pressure applicator 32 moves the firing unit longitudinally forward within the slide stand 36, until the trigger 26 collides with the trigger actuator 54 causing a discharge of ammunition. In the example of FIGS. 2-5, the trigger actuator 54 includes a rod supported transversely with respect to the slide stand 36. The rod may extend between two stretchers 42, and may be longitudinally adjustable to perfect its point of contact with the trigger 26. As will be discussed below, the trigger actuator 54 could alternatively take the form of an anchoring point or rest for a human finger and be so configured that the user's finger perched on the rest mimics the above-described rod to depress the trigger 26 in use. In other alternatives, the trigger actuator 54 could take the form of a cross-pin, wire or any other equivalent object placed in a position to intermittently make contact with the trigger 26.

In the standard implementation of the present invention carried out for the controlled rapid fire of the firearm 20, the fingers and palm(s) of one or both of the user's hands, or other suitable body part in the case of handicapped users, is maintained in continuous operative relationship with the spade grip 48. See FIGS. 4 and 5. The user's thumb(s) of the one or both hands, or other suitable body part in the case of handicapped users, is placed in pressing relation to the central thumb pad 32. When the user intends to discharge a round of ammunition from the firearm 20, they simply press forward with their thumb(s) against the thumb pad 32 so that the firing unit slides forwardly in the slide stand 36. When a sufficient minimum distance D (see FIG. 5) has been moved, the trigger actuator 54 engages and effectively "pulls" the trigger 24.

The discharging round of ammunition generates a recoil force along a vector that is generally parallel to the constrained linear path established by the sliding interface 50. Assuming the user does not continue to apply a force to the thumb pad 32 equal to or greater than the value of the recoil force (and accounting for the mass of the firing unit), the firing unit will be motivated by the recoil energy to travel in a reverse direction in the slide stand 36 by at least the distance D. In operation, a fairly brisk rate of firing can be achieved by rhythmically applying forward forces to the firing unit through the thumb pad 32 or other pressure applicator.

The user may optionally maintain pressure through their thumb(s) to the thumb pad 32 while the firing unit is translating rearwardly. This optional application of negative-resistance has several advantages. For one, it dampens the return travel of the firing unit thereby having a favorable effect on the perceived sense of reduced recoil. For another, it allows the user to maintain constant forward pressure through their thumb(s), selectively with varying or modulating force, which results in faster muscular reaction time as compared with motions that require direction reversals. Said another way, a moderately applied negative resistance can actually make a semi-automatic firearm repeat-fire at a faster rate than no negative resistance at all. A still further advantage is that the user can, if desired, change the firing rate tempo on the fly by varying the pressure they exert on the thumb pad 32 with their thumb(s) between zero and moderate negative resistance.

Permitting the firing unit to travel back-and-forth by the minimum distance D allows the trigger 26 to re-set. Re-setting triggers 26 are used with all semi-automatic type firearm 20, although the specific mechanics of re-setting may vary from one firearm type to another depending on the mechanical design of the trigger group assembly, the springs used therein, parts wear, lubrication qualities, etc. In most cases, the distance D may be established in the neighborhood of one inch (1") of travel. The relative sliding distance between the firearm 20 and the slide stand 36 is thus generally equal to the minimum distance D, but in practice may be designed as several times longer than the actual minimum separation distance needed to rest the trigger 26. In this way, the trigger 26 is reasonably assured to reset at some point while the firearm 20 separates from the slide stand 36 along the travel distance D. And as mentioned above, the trigger actuator 54 may be longitudinally adjustable relative to the trigger 26 so as to precisely set the point of contact and thus minimize the minimum distance D.

A safety lock feature, generally indicated at 56 in FIGS. 2-5, may be incorporated between the firearm 20 and the sliding stand 36 so that the firearm 20 can be selectively prevented from sliding back and forth. When the safety lock 56 is disengaged, the firearm 20 is free to slide relative to the slide stand 36. In the illustrated example, the safety lock 56 is carried on and moveable with the slide stand 36 (rather than carried on and moveable with the firing unit). The safety lock 56 may comprise a manually actuated switch 58 that is movable between locked and unlocked positions. In the locked position, the trigger actuator 54 is fixed at a spaced apart distance from the trigger 26, whereas in the unlocked position the trigger actuator 54 is free to reciprocate relative to the trigger 26. Naturally, this functionally can be accomplished in a multitude of ways.

One such exemplary implementation is shown wherein the manually actuated switch 58 is disposed on one handle of the spade grip 48 and conveniently depressed by way of a lever 60 by the user's fingers as they wrap around the one handle of the spade pip 48. Here, the lever 60 and switch 58 are joined through a pivot in something of a bell-crank fashion. When the switch 58 is positioned directly behind the thumb pad 32, it is in the locked position and prevents the firing unit from sliding forward in the slide stand 36. A spring bias (not shown) preferably acts on the safety lock 56 to continuously urge the switch 58 toward its locked position. When the user grasps the spade grip 48, their fingers can be manipulated to squeeze the lever 60, which in turn raises the switch 58 out from behind the thumb pad 32. I.e., squeezing of the lever 60 moves the switch 60 to its unlocked position so that the firearm 20 becomes operational.

The assembly may further include one or more optional sighting and/or aiming devices 62, represented more or less symbolically in several of the Figures as a rifle scope. Naturally, the sighting device 62 could be of the traditional aperture type sight, an optical type with telescopic lenses, a more modern holographic or reflector type sight, a laser projecting device, or any other suitable aiming device. The sighting device 62 also may be mounted on the slide stand 36 or firing unit in any suitable location.

A return spring (not shown) may optionally be placed between the firearm 20 and slide stand 36 to continuously urge the trigger 26 away from the trigger actuator 54. The return spring would help in cases where the mass of the firing unit combined with the trigger pull resistance and drag in the sliding interface 50 has the potential to exceed the recoil force. For example, if very light ammunition loads are used (e.g., a 22 caliber long rifle cartridge), the recoil could be too light to enable proper operation of the firearm 20 within the slide stand 36. A distinguishing feature of such a return spring would be that it acts in the direction of recoil rather than against the recoil. Said another way, such a return spring would not store recoil energy, but rather store energy supplied by the user through the thumb pad 32. The return spring would then release its stored energy in concert with the recoil so as to have a multiplying effect on the perceived recoil, thus helping to move the firing unit rearwardly in the slide stand 36.

Although the slide stand 36 is shown mated with an AR-15 type of firearm 20, it must be appreciated that with minor geometrical changes, the slide stand 36 may be configured to mount other types of semi-automatic firearms 20, including both rifles and pistols.

In the case of a handicapped operator that does not have use of at least one hand and thumb, the assembly can be reconfigured to allow an operator to apply various other forms of muscle effort through a modified pressure applicator, such as from the user's chest or foot. In all such cases, it is preferred that human muscle effort is the primary (if not exclusive) source of energy for moving the firearm 20 forward in the slide stand 36. For more severely handicapped users, the act of holding the slide stand 36 stationary is preferably accomplished via an articulated mounting arrangement 46 like that shown in FIG. 4. Amputees, quadriplegics, and others that may be challenged to manipulate objects requiring the use of their fingers previously had limited options to assist them when operating a firing unit. The present invention enables these individuals to operate the firearm 20 without the need to manipulate small and delicate pans as was typical in prior art shooting systems.

Figure 6:
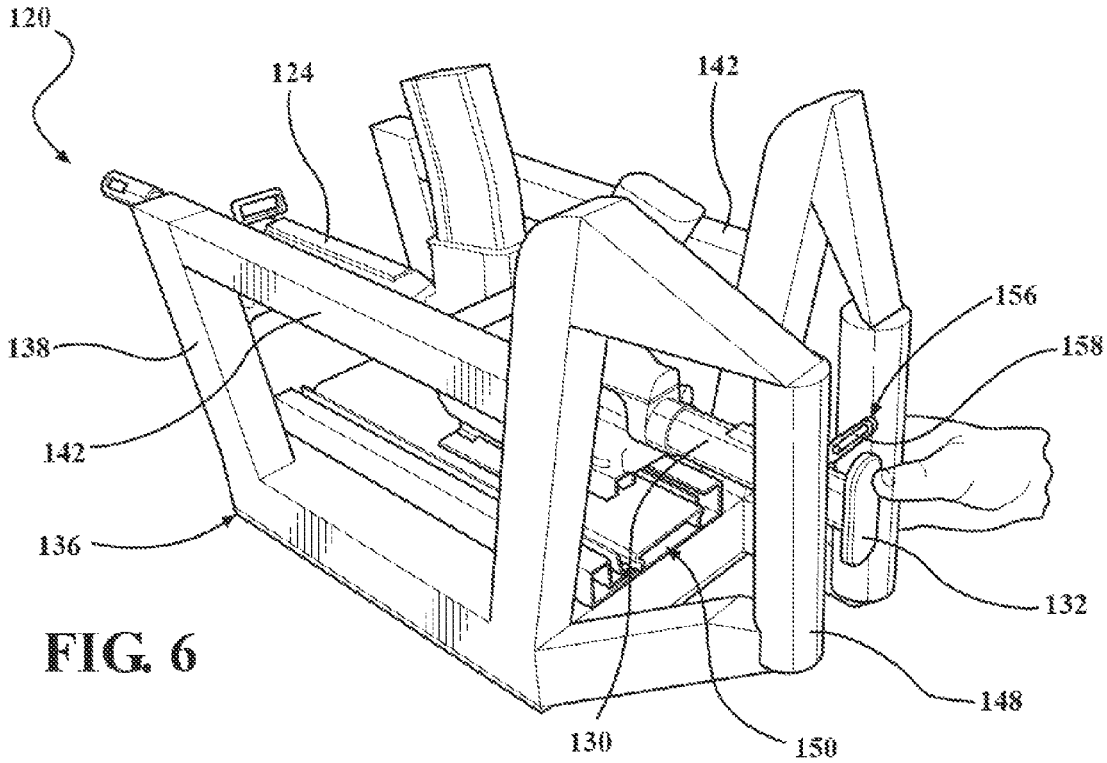
FIG. 6 is a perspective view of a firing unit disposed within a slide stand according to a second embodiment of the invention.
Figure 7:
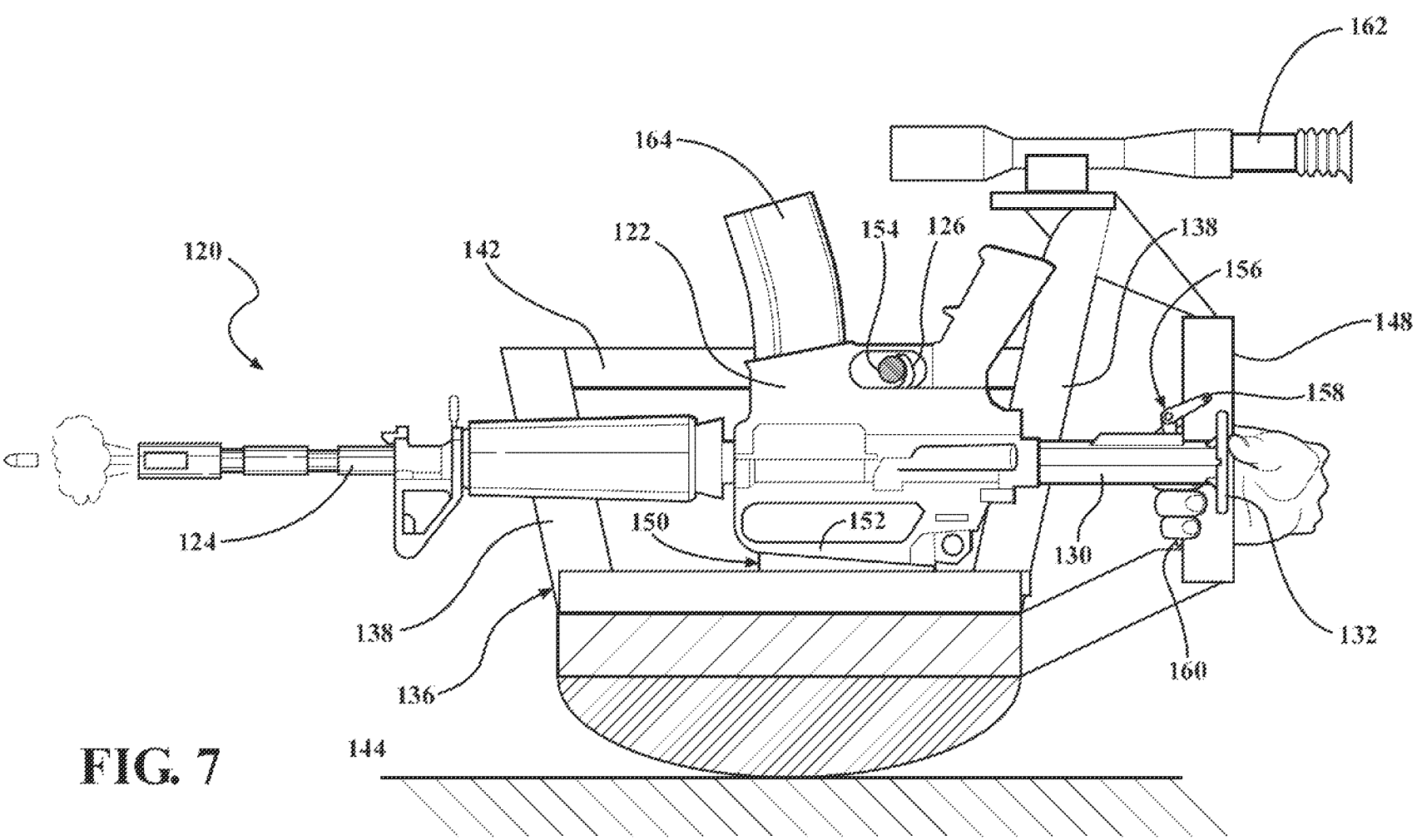
FIG. 7 is a partially sectioned side view of the firearm assembly of FIG. 6.
Figure 8:
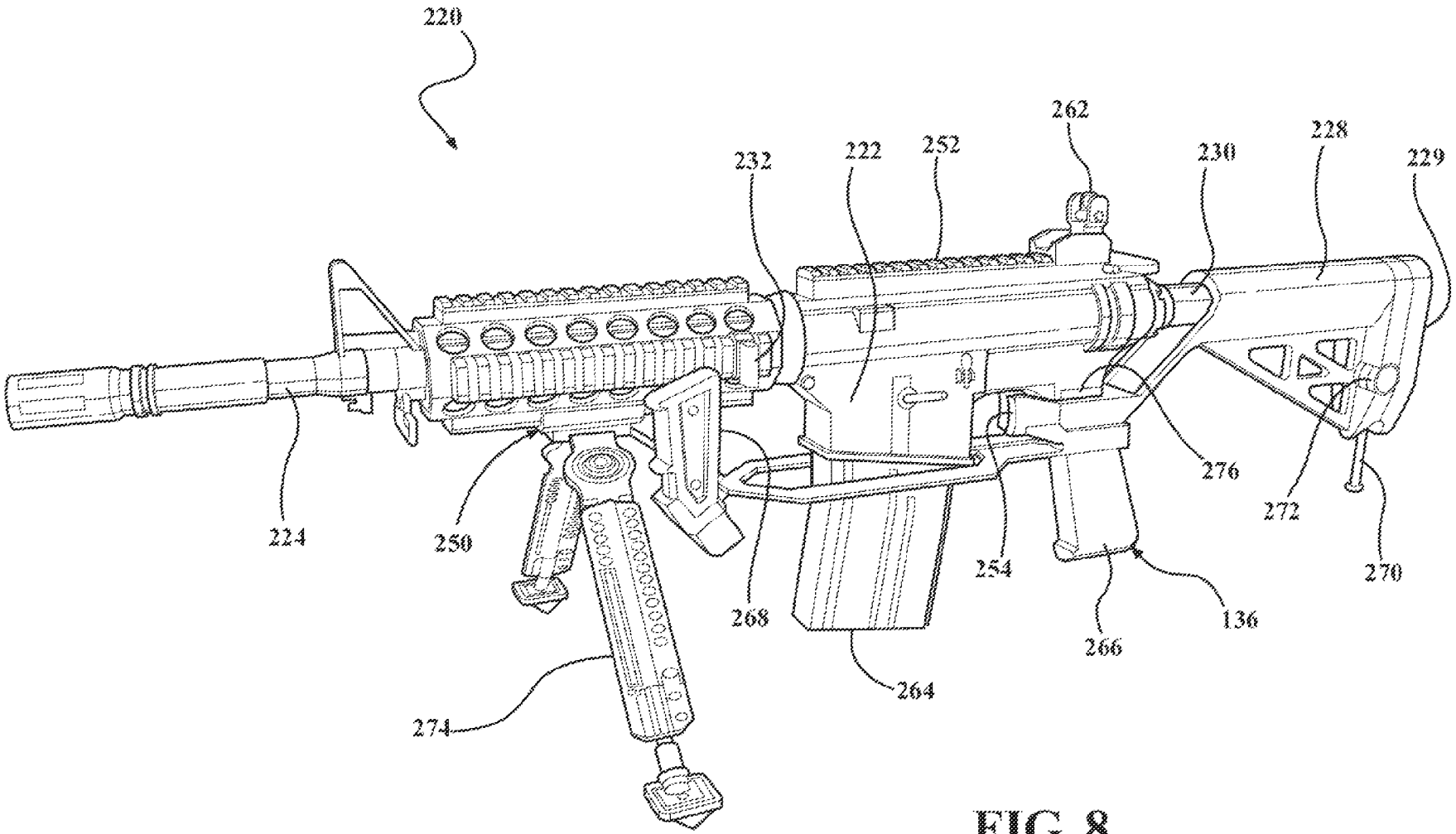
FIG. 8 is a perspective view of a firing unit disposed within a slide stand according to a third embodiment of the invention.
Figure 9:
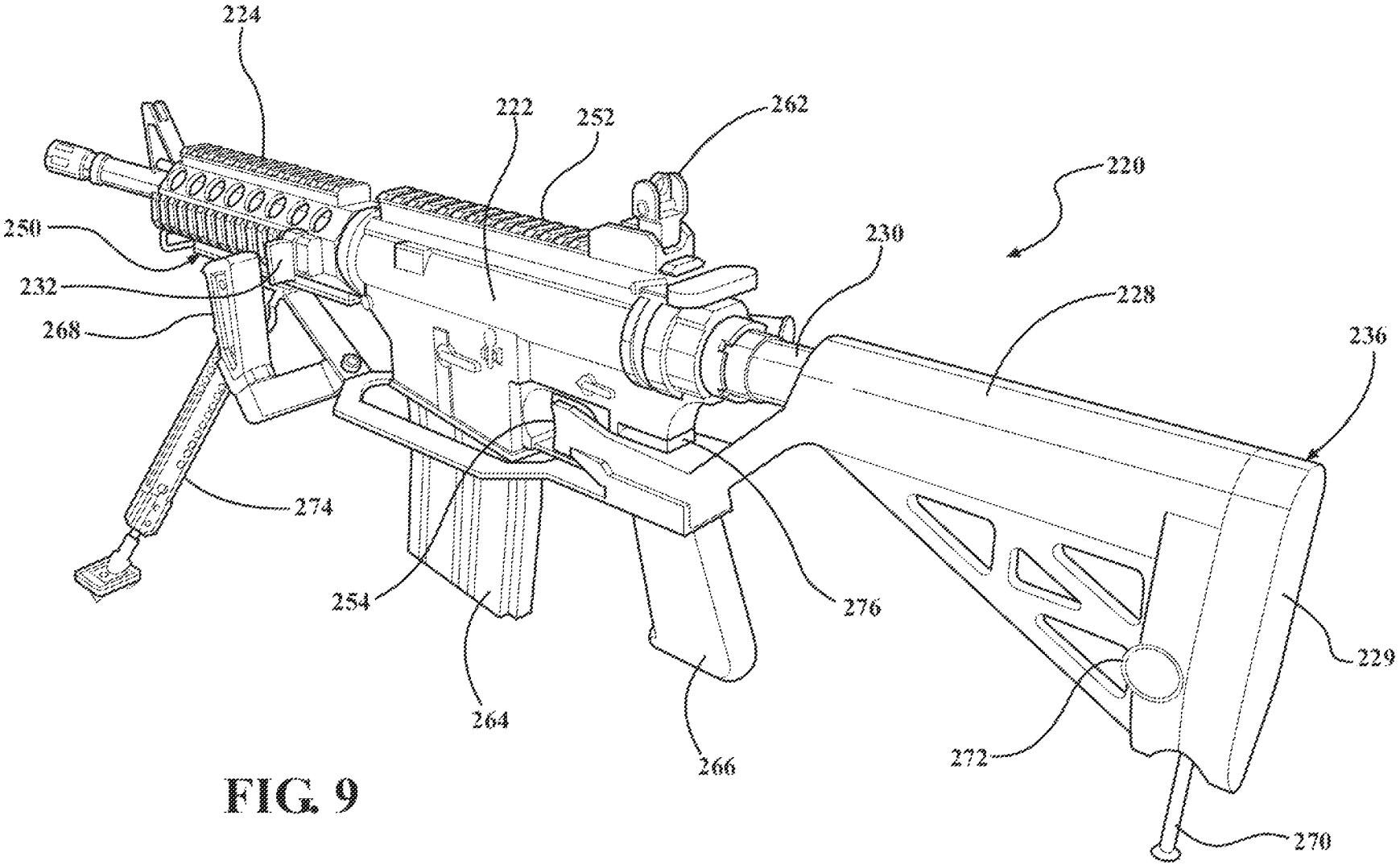
FIG. 9 is a perspective view of the third embodiment from a different vantage.
Figure 10:
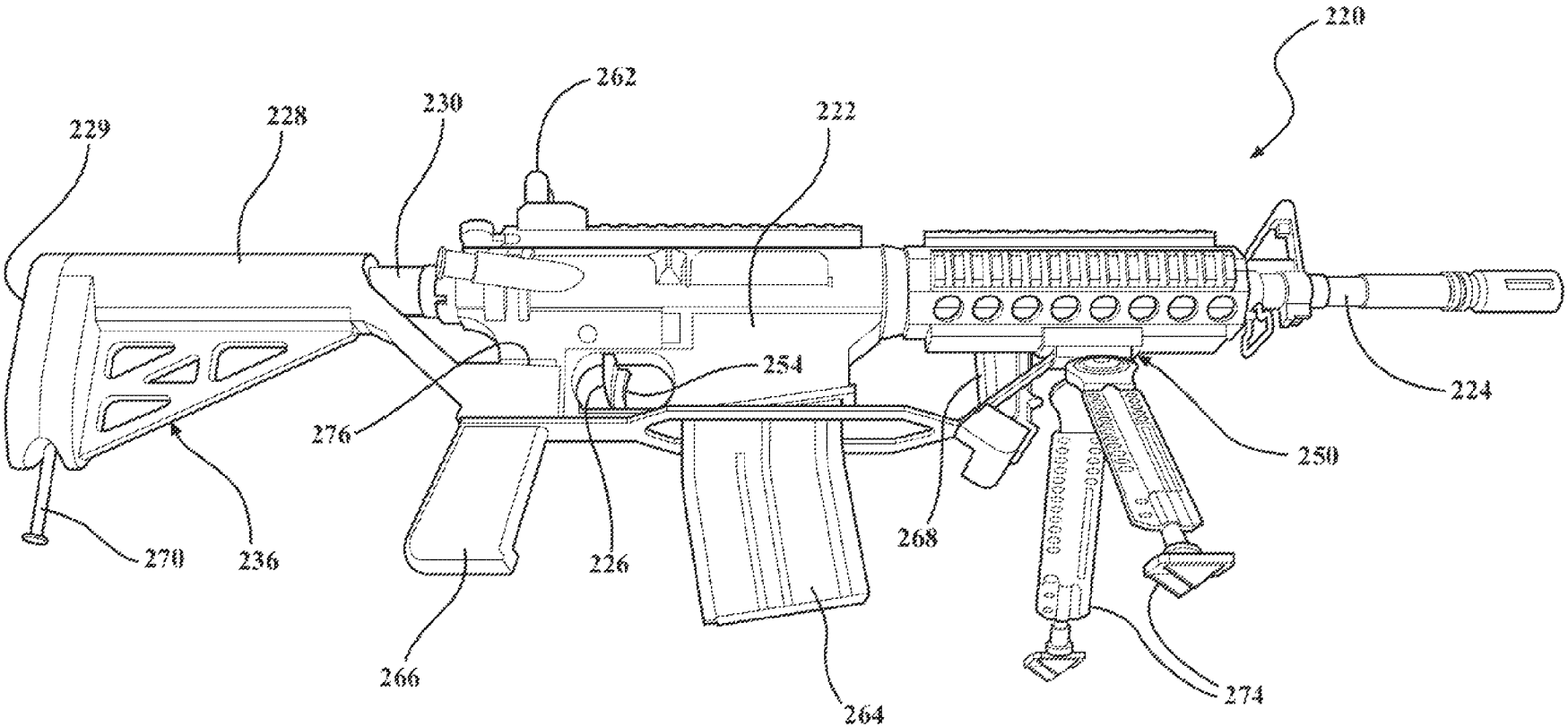
FIG. 10 is a perspective view of the third embodiment from yet another vantage.
Figure 11:
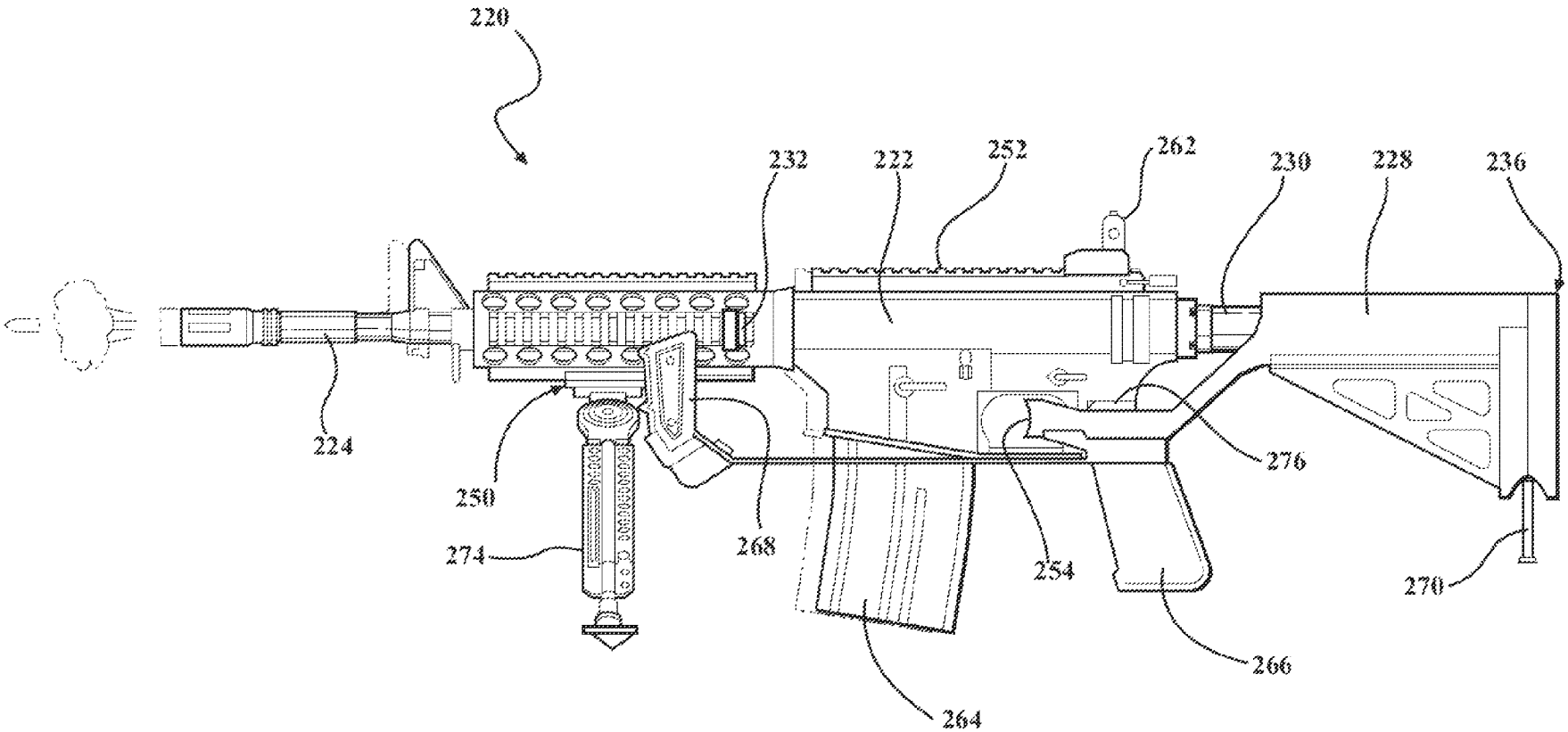
FIG. 11 is a side view of the third embodiment illustrating how the user's thumb action against the thumb pad actuates the firearm trigger.
Figure 12:
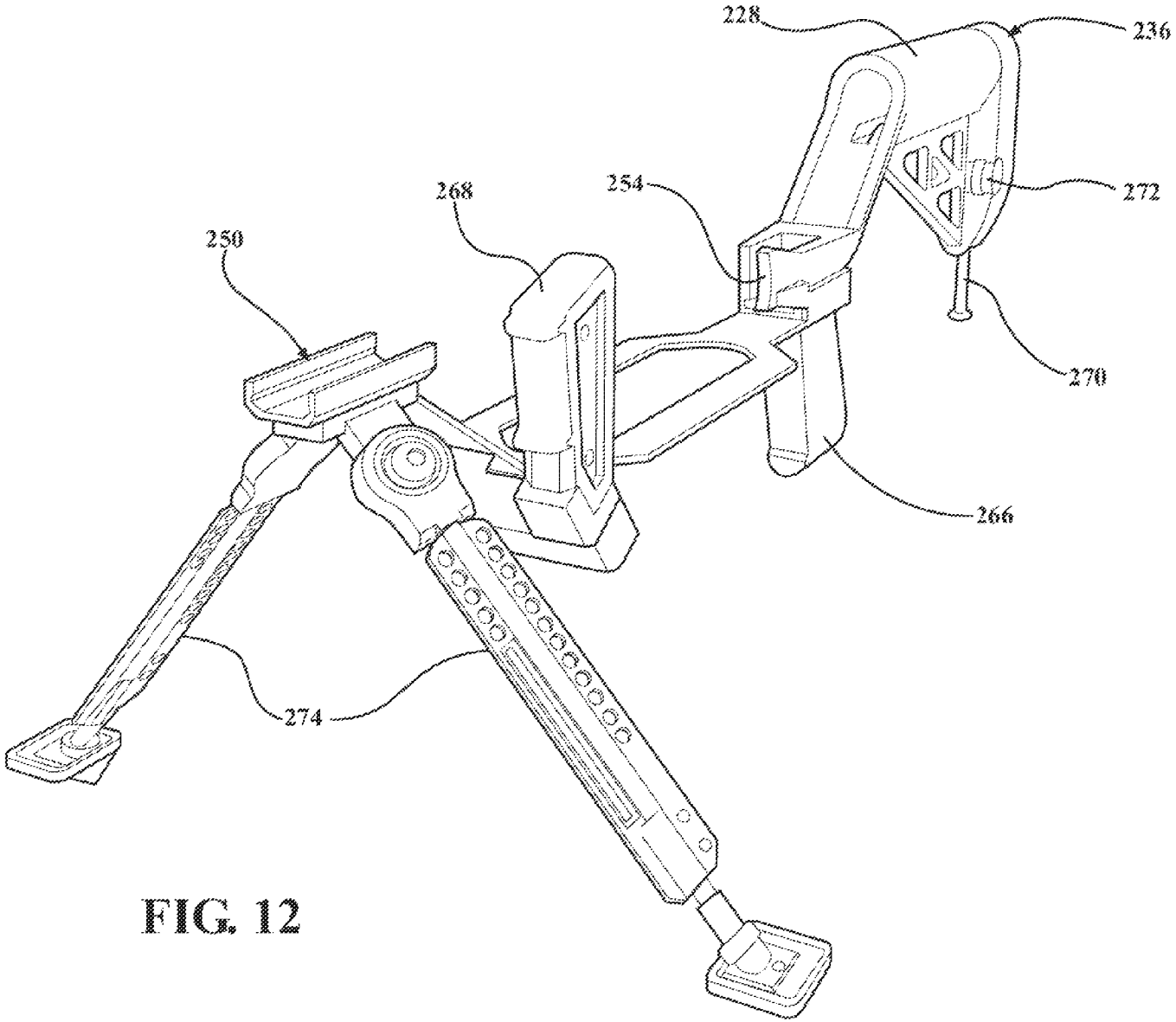
FIG. 12 is a perspective view of the slide stand alone according to the third embodiment.

FIGS. 6 and 7 illustrate an alternative embodiment of the firearm 120 assembly wherein like or corresponding features are identified with like reference numbers offset by 100. In this example, the firearm 120 and slide stand 136 are inverted by comparison with the preceding embodiment. All other basic aspects of the system function as in the previous embodiment. One advantage of this alternative embodiment resides in the convenience of changing cartridge magazines 164. That is, in order to supply the firearm 120 with ammunition, the magazine 164 can be easily removed with an upward motion in this alternative embodiment.

FIGS. 8-13 illustrate yet another alternative embodiment of the firearm 220 assembly wherein like or corresponding features are identified with like reference numbers offset by 200. In this example, the slide stand 236 is fitted with a non-articulating base for applications intended more-or-less for sharp-shooting and requiring a traditional two-handed hold by the user. Although the slide stand 236 continues to support the full or at least a significant portion of the assembly weight, the firearm 220 is held by a seated or prone user pulled tight against their shoulder so that the user's cheek lays against a side of the shoulder stock 228 for aiming.

The grip location(s) of the slide stand 236 are modified with respect to the preceding embodiments. Here, grip locations include a pistol grip 266 adjacent the trigger 226 combined with the shoulder stock 228 that extends rearwardly from the pistol grip 266. In addition, the grip location includes a front hand grip 268 adjacent the barrel 224. In normal use by an right-handed user, the right hand in wrapped around the pistol grip 266 and pulls the shoulder stock 228 into tight engagement with the right shoulder. The user's left hand is stretched out to grasp the front hand grip 268.

The sliding interface 250 in this embodiment includes a front rail bearing affixed adjacent to the barrel 224 of the firing unit, and more specifically under the barrel 224. In addition, the sliding interface includes a free sliding fit between the shoulder stock 228 and the buffer tube 230 of the firing unit. As with the reciprocating gun stock described in the applicant's own U.S. Pat. No. 8,176,835, the shoulder stock 228 slides back-and-forth upon the buffer tube 230 (or other bearing surface in the case of non-AR platforms). Controlled sliding motion may further be enhanced by the interaction of an interface block 276 attached to the lower receiver 222. (Again, other bearing surface structures may be employed in the case of non-AR platforms.) The interface block 276 attaches in place of the Original Equipment (OE) pistol grip. The interface block 276 not only helps provide a smooth sliding interface, but also contains the safety detent spring (not shown) in an operative position in the lower receiver 222. Thus, the sliding interface 250 is in fact two separated bearing surfaces in this example one near the front of the firing unit and the other near the rear of the firing unit.

The pressure applicator in this embodiment is also relocated near the front of the firing unit, and takes the firm of a thumb pad 232 disposed adjacent to the front hand grip 268. The thumb pad 232 extends laterally from the barrel 224 and is moveable therewith relative to the slide stand 236. At least one of the front hand grip 268 and/or the thumb and 232 can be made adjustable relative to the other to achieve an ergonomic relationship so that a user's forward hand can comfortably touch both grip 268 and pad 232 simultaneously.

The trigger actuator 254 in this embodiment includes a finger rest configured with a concave perch to stabilize a user's index finger in a partially extended condition over the trigger 226. As perhaps best shown in FIG. 8, the finger rest is disposed adjacent the pistol grip 266 so that in use the user's trigger finger stretches in front of the trigger 226 while the remaining fingers of the user's same hand grasp the pistol grip 266.

Instead of a convex or articulating base like that in the previous embodiments, in this example the base of the slide stand 236 is configured for relatively stable placement on an underlying support surface. The base may include a monopod 270 extending from the butt plate region of the shoulder stock 228. The monopod 270 can be made adjustable in its extension and also selectively retractable into a chamber or pocket inside the shoulder stock 228. A rotary adjustment wheel 272 may be provided for fine length adjustment of the monopod 270 to assist in aiming. He base may also include retractable biped legs 274 that extend in diverging downward directions from the barrel 224. In the illustrated example, the bipod legs 274 are attached below the front rail bearing of the sliding interface 250. The bipod legs 274 can be used with or without the monopod 270. By adjusting the monopod 270 and/or the bipod legs 274 in relation to the sighting device 262, the user can stabilize the slide stand 236 in an aimed position.

Figure 13:
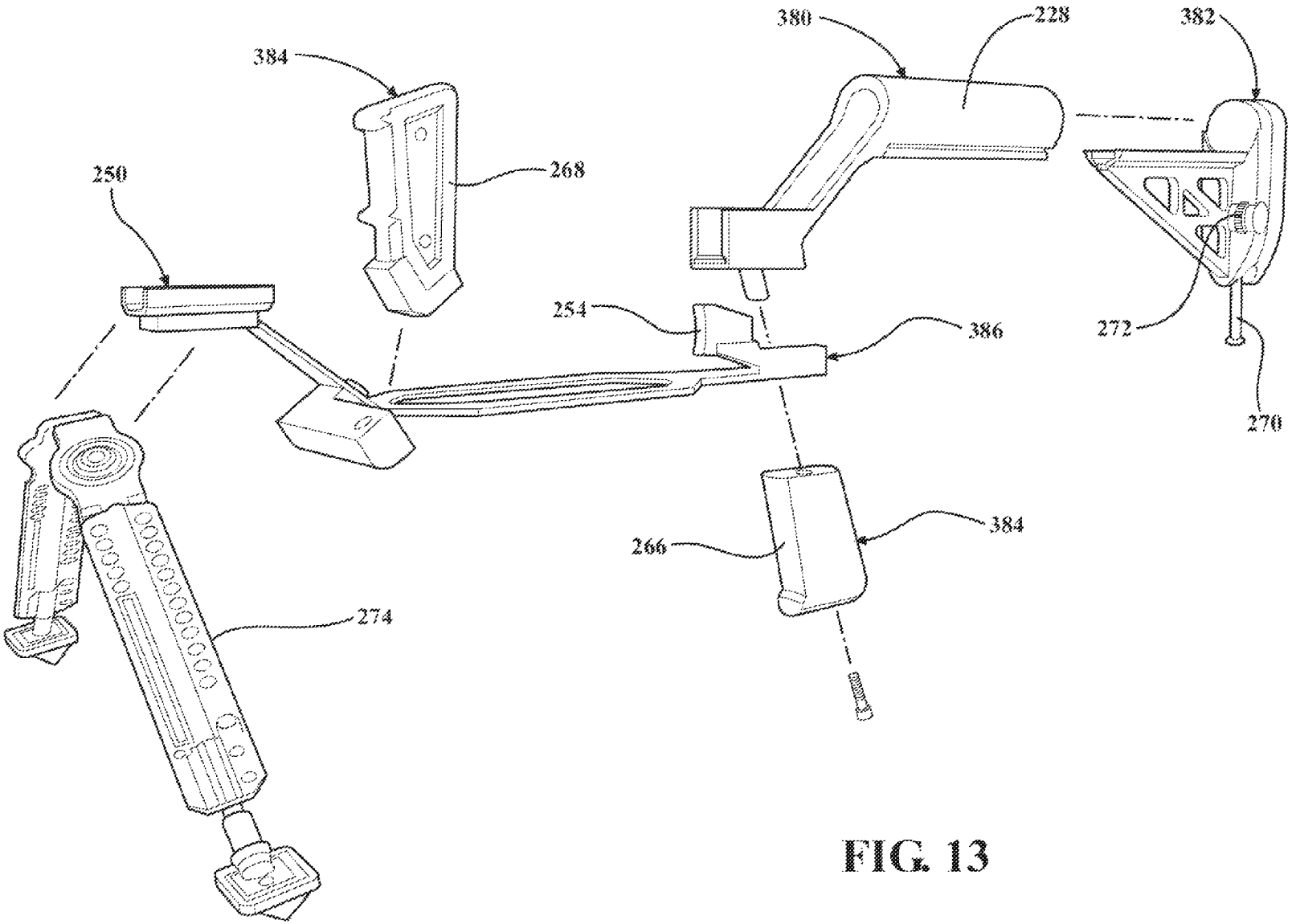
FIG. 13 is an exploded view of the various interchangeable modules of the third embodiment.

FIG. 13 depicts how the slide stand 236 of the present invention may be composed of multiple interchangeable modules. As with most things, people have preferences when it comes to semi-automatic firearms. Practically speaking, it would be extremely inefficient and expensive to manufacture a different slide stand 236 to suit the wide variety of consumer tastes. Therefore, this modular design can be implemented with interchangeable components, with each component, or module, offered in various styles to meet the demands of diverse users. The illustrated example shows four such modules referred to as the: core module 380, body module 382, grip module 384 and rest module 386. Thus, various styles of body modules 382 can be offered for the consumer to choose and replace at will with a common core module 380. The rest module 386 could be manufactured in interchangeable left-hand and right-hand versions. The grip modules 384 can be made from various colors, materials, sizes, etc., and interchanged at will by the user. It is contemplated that more or fewer modules may be used without departing from the spirit of this invention. For example, the body module 382 could be permanently integrated with the core module 380. Or, the body module 382 may include an interchangeable back-end module. Preferably, a snap-fit or other type of self-locking connection is used so that the components can be assembled (and disassembled) without tools, but that hold together securely in use. However, those of skill in the manufacturing arts will envision many alternative ways in which the various modules can be joined together.

In use, assuming a right-handed shooter as an example, the right hand grasps the pistol grip 266 with the index finger of that hand stretched across the trigger 226 but not touching the trigger 226. The shoulder stock 228 is pulled into tight engagement with the user's right shoulder. The user's left hand is stretched forward to clench the front hand grip 268. The thumb of the same left hand extends across to the thumb pad 232. When the user is ready to fire a bullet from the firearm 220, they apply forward pressure from their left thumb against the thumb pad 232. The slide stand 236 remains firmly planted on the underlying support surface. As a result of the user's thumb pressure, the firing unit slides forwardly in the stand 236 the minimum distance D until the trigger 226 contacts and is depressed by the user's right index finger held fast against the finger rest of the actuator 254. Pulling of the trigger 226 in this manner causes the firearm 220 to discharge a bullet, which in turn generates recoil energy that slides the firing unit rearwardly in the slide stand 236.

When the user intends to discharge another round of ammunition from the firearm 220, they simply press forward again with their left thumb against the thumb pad 232 so that the firing unit again slides forwardly in the slide stand 236. The user may optionally maintain pressure through their left thumb on the thumb pad 232 while the firing unit is translating rearwardly to create the negative-resistance phenomena described above. An experienced user of this invention thus will develop a new and interesting, shooting form. If the user decides to decrease their application of thumb pressure to zero or nearly zero during the recoil event, the firearm 220 will slide rearwardly quite rapidly. Once the trigger 226 is reset, the user will then increase their muscle effort to translate the firearm 220 within the slide stand 36 and thereby rapidly return the firearm to a tiring condition.

The slide stand 36, 136, 236 is shown in configured for attachment to an AR-15 type semi-automatic firearm, however those of skill in this art will appreciate that, with minor modifications, the slide stand 36, 136, 236 can be readily adapted to any suitable semi-automatic firearm 20, 120, 220 such as the AR-10, SKS, FN-FAL, Mini 14, MAC-11, TEC-22, HK-91, HK-93, M1-A, K-1, K-2, and Ruger 10-22 devices to name but a few. The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A semi-automatic firearm and mount assembly comprising:

a semi-automatic firing unit, said firing unit including a receiver and a barrel and a trigger, said firing unit including a pressure applicator, a slide stand for supporting the weight of said firing unit on or from a support structure, said slide stand including a sliding interface slidably connecting to said firing unit so that in use said firing unit freely reciprocates back-and-forth relative to said slide stand, said sliding interface establishing a constrained path of reciprocation generally parallel to said firearm barrel, said slide stand including at least one grip location for a user to grasp when firing said firearm, a trigger actuator configured to depress said trigger when said firing unit is moved forwardly in said slide stand, and said slide stand and said firing unit being arranged without spring force assistance acting therebetween so that in use a user's muscle effort applied through said pressure applicator moves said firing unit longitudinally forward within said slide stand to press said trigger actuator into said trigger in order to discharge a round of ammunition without requiring the user to support the weight of said firing unit.

2. The assembly of claim 1 wherein said pressure applicator includes a thumb pad.

3. The assembly of claim 2 wherein said thumb pad extends laterally from said barrel and is moveable therewith relative to said slide stand.

4. The assembly of claim 3 wherein said grip location includes a front hand grip adjacent said barrel, and said thumb pad is disposed adjacent to said front hand grip.

5. The assembly of claim 2 wherein firing unit includes a buffer tube extending rearwardly from said receiver to a distal end, said thumb pad being attached to said distal end of said buffer tube.

6. The assembly of claim 2 wherein said grip location includes a pair of rear handles disposed on opposite sides of said thumb pad.

7. The assembly of claim 1, wherein said grip location includes a pistol grip adjacent said trigger, and said grip location includes a shoulder stock extending rearwardly from said pistol grip, said slide stand includes a monopod extending from said shoulder stock, said monopod being selectively retractable into said shoulder stock.

8. The assembly of claim 1 wherein said sliding interface includes a rail system affixed to said receiver.

9. The assembly of claim 1 wherein said sliding interface includes a front rail bearing affixed adjacent to said barrel.

10. The assembly of claim 9 wherein said slide stand includes bipod legs extending in diverging downward directions from said barrel, said bipod legs extending from said front rail bearing of said sliding interface.

11. The assembly of claim 1 wherein said slide stand includes a convex base.

12. The assembly of claim 1 wherein said slide stand includes an articulating pintle mount base.

13. The assembly of claim 1 wherein said trigger actuator includes a rod fixed transversely with respect to said slide stand.

14. The assembly of claim 1 wherein said trigger actuator includes a finger rest configured to stabilize a user's index finger in a partially extended condition over said trigger.

15. The assembly of claim 1 further including a safety lock operatively disposed between said firing unit and said slide stand for selectively preventing said firing unit from sliding back and forth with respect to said slide stand.

16. The assembly of claim 15 wherein said safety lock has a manually actuated switch movable between locked and unlocked positions, said manually actuated switch disposed on said grip location.

17. A mount assembly for a semi-automatic firearm of the type including a receiver and a barrel and a trigger moveable together as a firing unit, said assembly comprising:

a pressure applicator configured for rigid attachment to the firing unit, a slide stand for supporting the weight of the firing unit on or from a support structure, said slide stand including a sliding interface slidably configured for attachment to the firing unit so that in use the firing unit freely reciprocates back-and-forth relative to said slide stand, said sliding interface establishing a constrained path of reciprocation generally parallel to the firearm barrel, said slide stand including at least one grip location for a user to grasp when firing the firearm, a trigger actuator configured to depress the firearm trigger when the firing unit is moved forwardly in said slide stand in response to user force applied to said pressure applicator, and said slide stand being arranged without spring force assistance to act against the firing unit so that in use a user's muscle effort applied through said pressure applicator moves the firing unit longitudinally forward within said slide stand to press said trigger actuator into the trigger in order to discharge a round of ammunition and without requiring the user to support the weight of the firing unit.

18. The assembly of claim 17 wherein said pressure applicator includes a thumb pad.

19. The assembly of claim 18 wherein said grip location including a pair of rear handles disposed on opposite sides of said thumb pad.

20. The assembly of claim 17 wherein said sliding interface includes a front rail bearing affixed adjacent to the barrel.

21. The assembly of claim 17 wherein said trigger actuator includes a rod fixed transversely with respect to said slide stand.

22. The assembly of claim 17 wherein said trigger actuator includes a finger rest configured to stabilize a user's index finger in a partially extended condition over said trigger.

23. The assembly of claim 17 further including a lock operatively disposed between the firing unit and said slide stand for selectively preventing the firing unit from sliding back and forth with respect to said slide stand.

24. The assembly of claim 23 wherein said lock has a manually actuated switch movable between locked and unlocked positions, said manually actuated switch disposed on said grip location.

* * * * *